US008347437B2

(12) United States Patent
Kim et al.

(10) Patent No.: US 8,347,437 B2
(45) Date of Patent: Jan. 8, 2013

(54) WASHING MACHINE AND CONTROL METHOD THEREOF

(75) Inventors: Pyoung Hwan Kim, Changwon-si (KR); Soo Young Oh, Changwon-si (KR)

(73) Assignee: LG Electronics Inc., Seoul (KR)

( * ) Notice: Subject to any disclaimer, the term of this patent is extended or adjusted under 35 U.S.C. 154(b) by 979 days.

(21) Appl. No.: 12/289,802

(22) Filed: Nov. 4, 2008

(65) Prior Publication Data

US 2009/0139278 A1 Jun. 4, 2009

(30) Foreign Application Priority Data

Nov. 5, 2007 (KR) ..... 10-2007-0112022

(51) Int. Cl.
*D06F 33/00* (2006.01)
*D06F 39/04* (2006.01)

(52) U.S. Cl. ..... 8/149.1; 8/159

(58) Field of Classification Search ..... 8/149.1, 8/149.2, 149.3, 158, 159
See application file for complete search history.

(56) References Cited

U.S. PATENT DOCUMENTS

| | | | | |
|---|---|---|---|---|
| 6,553,596 | B2 * | 4/2003 | Kim et al. | 8/159 |
| 2003/0024056 | A1 * | 2/2003 | Kim et al. | 8/158 |
| 2004/0237603 | A1 * | 12/2004 | Kim et al. | 68/15 |
| 2005/0160536 | A1 * | 7/2005 | McAllister et al. | 8/137 |
| 2006/0000242 | A1 * | 1/2006 | Yang et al. | 68/5 R |
| 2007/0107472 | A1 * | 5/2007 | Kim et al. | 68/5 R |
| 2008/0016626 | A1 * | 1/2008 | Oak et al. | 8/158 |
| 2008/0216249 | A1 * | 9/2008 | Sa et al. | 8/158 |

FOREIGN PATENT DOCUMENTS

| | | | |
|---|---|---|---|
| CN | 86100859 | | 9/1987 |
| CN | 1637191 | | 7/2005 |
| JP | 05-131090 | | 5/1993 |
| JP | 09-056969 | | 3/1997 |
| KR | 10-2005-0072293 | | 7/2005 |
| WO | WO 2006/009364 | A | 1/2006 |
| WO | WO 2007026989 | A1 * | 3/2007 |
| WO | WO 2008/091124 | A | 7/2008 |

* cited by examiner

*Primary Examiner* — Joseph L Perrin
(74) *Attorney, Agent, or Firm* — McKenna Long & Aldridge LLP

(57) ABSTRACT

A washing machine and a control method thereof are disclosed. The control method includes supplying water into a tub, washing an object to be washed via rotation of a drum, rinsing the washed object, and dehydrating the washed object to remove moisture from the object. In the water supply step, steam is ejected simultaneously with the supply of water, to regulate the interior temperature of the drum.

4 Claims, 4 Drawing Sheets

WASHING MACHINE AND CONTROL METHOD THEREOF

This application claims the benefit of the Korean Patent Application No. 10-2007-0112022, filed on, Nov. 5, 2007, which is hereby incorporated by reference as if fully set forth herein.

BACKGROUND OF THE INVENTION

1. Field of the Invention

The present invention relates to a washing machine and a control method thereof, and more particularly, to a washing machine capable of washing functional clothes including sportswear without damage, and a control method thereof.

2. Discussion of the Related Art

Generally, washing apparatuses include a washing machine to wash an object, a drying machine to dry an object, and a washing machine having dual functions with washing and drying combined, and the like. Here, a conventional washing machine performs water-supply, washing, rinsing and dehydrating steps to completely wash an object to be washed. With relation to the water-supply step wherein wash water is supplied into a drum of the washing machine, there has been recently developed a washing machine having a heater to heat the wash water so as to regulate the interior temperature of the drum.

In the washing step wherein the drum is intermittently rotated to thereby complete the washing of the object, a rotation time of the drum is typically longer than a stoppage time of the drum in order to achieve enhanced washing capability.

After completion of the washing step, the rinsing and dehydrating steps are followed.

In the above-described conventional washing machine, however, appropriately regulating a water temperature, washing time, drum rotation time, dehydration rpm and the like on a per step basis in consideration of various kinds of objects to be washed is difficult.

Recently, demand for functional clothes including sportswear is continuously increasing according to a recent increase in interest in sports. However, such functional clothes including sportswear are fabricated using special materials suitable for desired functions thereof, for example, a material which is impermeable to moisture and permeable to air. Accordingly, when the functional clothes fabricated using appropriate materials in conformity to functions thereof are washed via a typical washing course for general objects, it causes damage to cloth and the like, making it impossible for the functional clothes to exhibit unique functions thereof.

SUMMARY OF THE INVENTION

Accordingly, the present invention is directed to a washing machine and a control method thereof that substantially obviate one or more problems due to limitations and disadvantages of the related art.

An object of the present invention is to provide a washing machine capable of washing functional clothes including sportswear without damage, and a control method thereof.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and Claims hereof as well as the appended drawings.

To achieve these objects and other advantages and in accordance with the purpose of the invention, as embodied and broadly described herein, a method for controlling a washing machine comprises: supplying water into a tub; washing an object to be washed via rotation of a drum; rinsing the washed object; and dehydrating the washed object to remove moisture from the object, wherein steam is ejected simultaneously with the supply of water in the water supply step, to regulate the interior temperature of the drum.

In the water supply step, cold water may be supplied. The interior temperature of the drum may be regulated, using the steam, to a range of 25° C. to 30° C. Preferably, the interior temperature of the drum is regulated to 27° C. or less.

The drum may be intermittently rotated in the washing step. A total stoppage time of the drum may be longer than a total rotation time of the drum. More specifically, the total stoppage time of the drum may be more than double the total rotation time of the drum.

In the dehydrating step, to prevent damage to clothes, a rotation rpm of the drum may be regulated to 400 rpm or less.

In accordance with another aspect of the invention, there is provided a washing machine comprising: a drum in which clothes are received; a tub in which the drum is rotatably installed; a steam generating device to generate steam to be supplied into the drum; a selecting device to select a plurality of washing courses including a functional clothes washing course; and a controller to control the drum and steam generating device based on the washing course selected by the selecting device.

The functional clothes washing course selected by the selecting device may include a water supply step, a washing step, a rinsing step and a dehydrating step, and the controller may regulate the interior temperature of the drum by ejecting the steam, generated from the steam generator, into the drum while supplying cold water into the drum in the water supply step.

The controller may regulate the interior temperature of the drum to a range of 25° C. to 30° C. Preferably, the controller may regulate the interior temperature of the drum so 27° C. or less.

The controller may control the drum to be intermittently rotated in the washing step. The controller may control the rotation of the drum such that a total stoppage time of the drum is longer than a total rotation time of the drum. More specifically, the total stoppage time of the drum may be more than double the total rotation time of the drum.

The controller may control rotation of the drum such that a rotation rpm of the drum is 400 rpm or less in the dehydrating step.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a configuration of a washing machine according to an embodiment of the present invention will first be described and subsequently, a control method thereof will be described.

Figure 1:
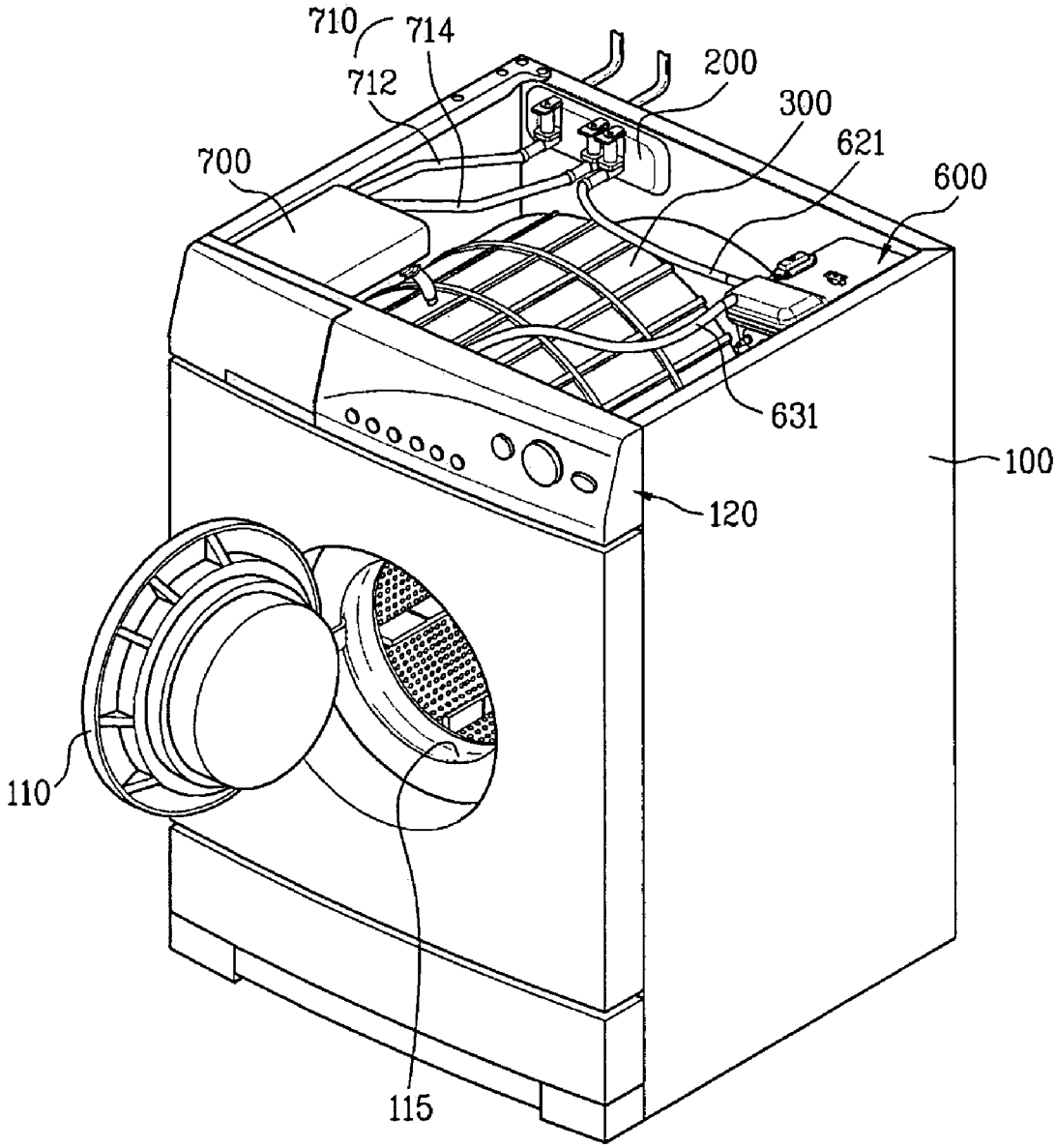
FIG. 1 is a perspective view illustrating a washing machine according to an embodiment of the present invention.
Figure 2:
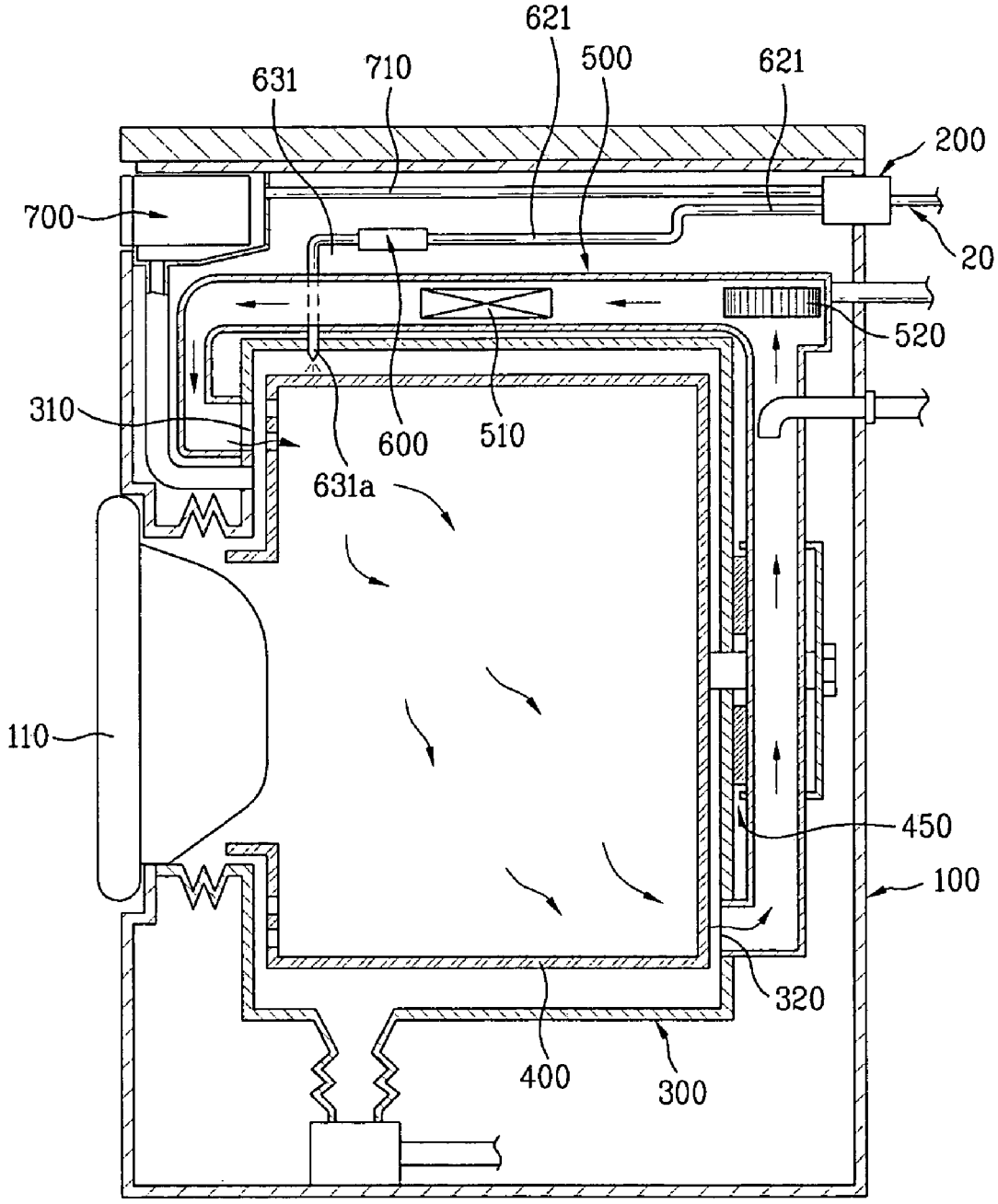
FIG. 2 is a side sectional view illustrating an interior configuration of the washing machine of FIG. 1.

FIG. 1 is a perspective view illustrating a washing machine according to an embodiment of the present invention, and FIG. 2 is a side sectional view illustrating an interior configuration of the washing machine of FIG. 1. In FIG. 1, to show the interior of the washing machine, a top cover is not illustrated.

Referring to FIGS. 1 and 2, a configuration of the washing machine will now be described.

The washing machine includes a body 100 defining the external appearance of the washing machine, a cylindrical tub 300 horizontally supported in the body 100 and serving to store wash water therein, a drum 400 rotatably installed in the tub 300, and a drive motor 450 to drive the drum 400.

The body 100 is formed, at a front side thereof, with an opening 115 in communication with the interior of the drum 400 for putting or taking laundry into or out of the drum 400. A door 110 is coupled to the body 100, to open or close the opening 115. A water supply valve 200 is provided at one side of the washing machine and is connected with an exterior water tap (not shown) or the like, so as to supply wash water into the tub 300. Conventionally, a water supply tube 710 is connected between a detergent container 700 and the water supply valve 200. The water supply tube 710 consists of a hot water tube 714 and a cold water tube 712.

Although not shown in the drawings, a heater may be provided at an inner bottom surface of the tub 300. The heater 300 serves to heat wash water, supplied into the tub 300, to an appropriate temperature when a user wishes to wash laundry using hot water.

A steam generating device 600 may be provided in the body 100, to supply steam into the drum 400. The steam generating device 600 is connected at one side thereof with a water supply hose 621 through which water is supplied, and at the other side thereof with a steam supply tube 631 through which steam is supplied into the drum 400.

The water supply hose 621 is typically connected to a hot water outlet of the water supply valve 200. The steam supply tube 631 is preferably provided at a distal end thereof with a nozzle 631*a* to effectively eject steam into the drum 400. Also, the distal end of the steam supply tube 631, from which steam is discharged, is preferably exposed to the interior of the drum 400. Although not shown in the drawings, the steam supply tube 631 is preferably provided with an on-off valve to enable selective ejection of steam.

The washing machine according to the embodiment of the present invention may have a function to dry a washed object. For this, a drying duct 500 may be provided in the body 100, to define a flow path for supplying hot air into the drum 400. For this, the drying duct 500 incorporates a drying heater 510 to heat air to be supplied into the drum 400, and a blowing fan 520 to forcibly blow hot air heated by the drying heater 510 into the drum 400. The tub 300 is formed with a hot air inlet 310 and a hot air outlet 320, through which hot air heated by the drying heater 510 is introduced into or discharged from the tub 300.

Figure 3:
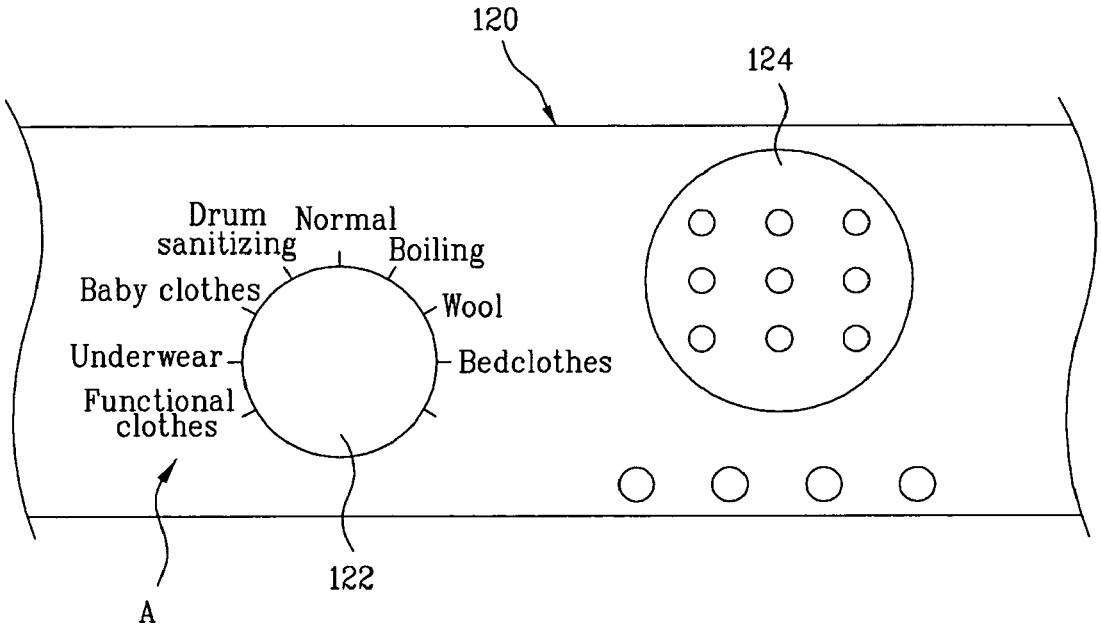
FIG. 3 is a front view of a selecting device provided in the washing machine of FIG. 1.

A control panel 120 is mounted at a front surface or upper surface of the body 100 of the washing machine, to control driving of the washing machine. FIG. 3 is a front view of the control panel 120 provided at the washing machine of FIG. 1. In FIG. 1, for convenience of illustration, the control panel 120 is only schematically illustrated.

Referring to FIG. 3, the control panel 120 may be provided at, for example, the front surface of the washing machine of FIG. 1. The control panel 120 basically includes a selecting device 122 using which one of washing courses including one or more steam courses is selected, and an auxiliary selecting device 124 using which preset values for washing conditions based on the washing course selected from the selecting device 122, for example, the amount and temperature of wash water, the number of rinsing cycles, the number of dehydrating cycles, and the like can be regulated.

A user will select an appropriate washing course using the selecting device 122 in consideration of the kind and amount of laundry to be washed, and the like, and the washing machine is provided with a controller (not shown) in which default data of the amount and temperature of wash water, the number of rinsing cycles, the number of dehydrating cycles, and the like are stored. Accordingly, if the user selects a washing course, a washing operation is performed based on default data stored in the controller.

After selection of the washing course as described above, the amount and temperature of wash water, the number of rinsing cycles, the number of dehydrating cycles, and the like can be input based on the selected washing course by the user. For this, the auxiliary selecting device 124 may be provided. Specifically, once the user selects a washing course using the selecting device 122, the user can manually input and regulate preset values for washing conditions based on the selected washing course. Accordingly, after selecting a washing course using the selecting device 122, regulation of the amount and temperature of wash water, the number of rinsing cycles, the number of dehydrating cycles, and the like is possible using the auxiliary selecting device 124. Preferably, the regulated values are temporarily stored in the controller to perform the selected washing course and then, are removed after the selected course ends.

In the washing machine according to the embodiment of the present invention, the selecting device 122 has one or more steam courses for ejection of steam, and at least one of the steam courses is called a functional clothes course A to wash functional clothes including sportswear.

Recently, demand for functional clothes including various kinds of sportswear is remarkably increasing. In consideration of the fact that sportswear is worn during exercise, the sportswear requires different characteristics from general clothes. That is, the sportswear must easily discharge moisture, such as sweat emitted from the body during exercise, to the outside of the sportswear while preventing moisture, such as rainwater and the like, from penetrating the sportswear. Moreover, the sportswear must provide proper ventilation during exercise to provide comfort.

Currently, various kinds of materials having the above-described characteristics have been developed. For example, materials, such as Gore-tex®, Coolmax® and the like, have been introduced. Here, it should be noted that these materials, such as Gore-tex®, Coolmax® and the like, have the above-described characteristics, but are not heat resistant and are easily damaged by friction and the like.

Accordingly, if functional clothes including sportswear formed of materials that are not heat resistant and are easily damaged by friction and the like are washed via a conventional washing course, there is a risk of damaging the functional clothes. Generally, a drum is rotated during a washing operation in such a manner that a drum rotation time is longer than a drum stoppage time. For example, a drum is rotated for 19 seconds, and is stopped for 5 seconds. Although such a longer drum rotation time increases washing capability of the washing machine, with relation to washing of the functional clothes, the functional clothes may be damaged due to low frictional-resistance characteristics thereof.

This is similarly applied upon dehydration. Specifically, if a drum is rotated at 800 rpm or more in a conventional dehydrating manner, the functional clothes may be damaged by friction with the drum.

Moreover, in the case where hot water heated by a heater is supplied into a drum to easily remove dirt and the like upon washing of the functional clothes, the heated hot water may damage the functional clothes. In particular, direct contact between the heated hot water and the functional clothes may cause serious damage to the functional clothes.

Figure 4:
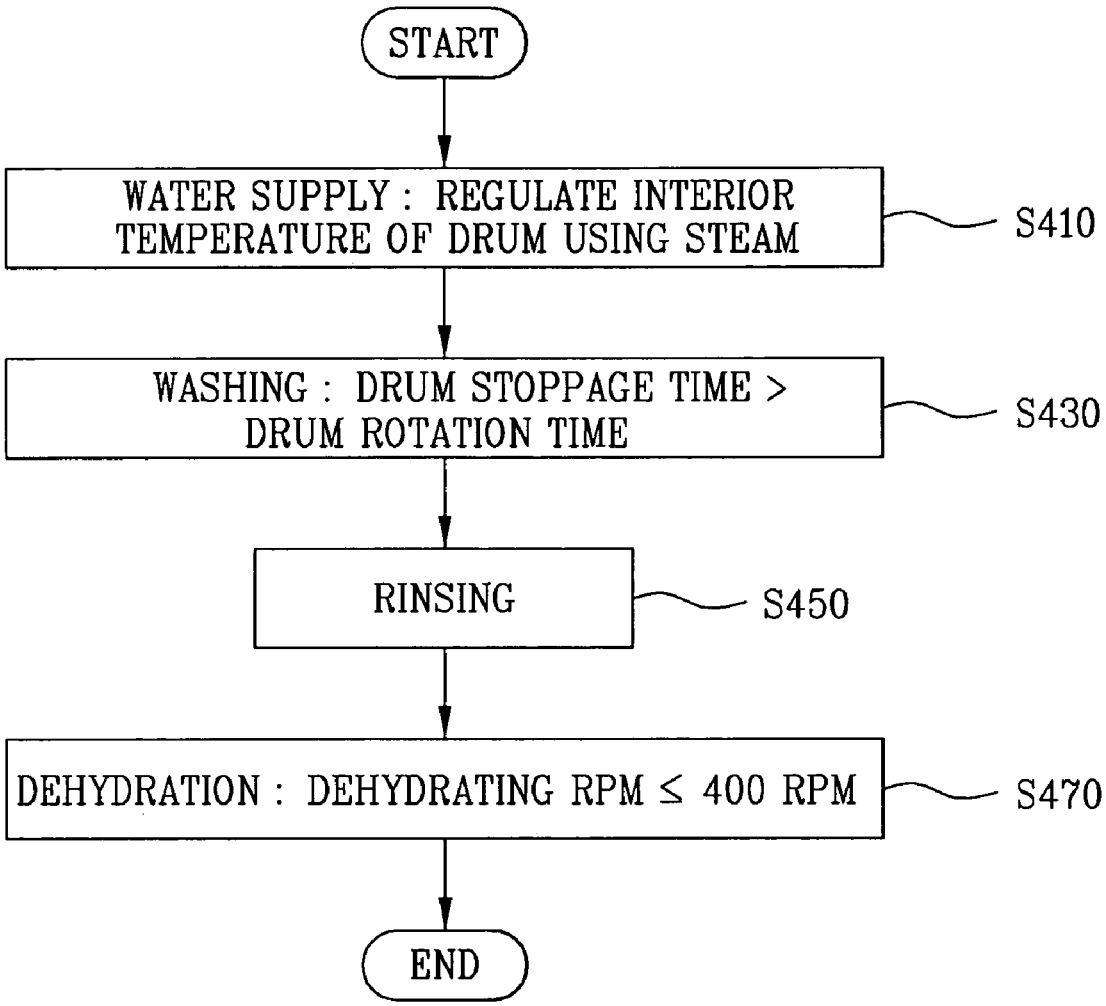
FIG. 4 is a flow chart illustrating a control method according to an embodiment of the present invention.

Accordingly, to wash the above-described functional clothes without damage, in the washing machine according to the present invention, the selecting device 122 has a so-called "functional clothes course" A. Hereinafter, driving of the washing machine when the user selects the functional clothes course using the selecting device 122 will be described with reference to FIG. 4.

First, the user inputs functional clothes including sportswear into the drum 400 of the washing machine, selects the functional clothes course A by manipulating the selecting device 122, and pushes an operating button (not shown).

Subsequently, a water supply step to supply water into the tub 300 is performed (S410). In this case, the controller (not shown) commands that cold water be supplied into the tub 300 and simultaneously, that steam be supplied into the drum 400 via operation of the steam generating device 600 so as to control the interior temperature of the drum 400. In the present embodiment, when the user selects the functional clothes course A, the water supply step is performed in such a manner that the interior temperature of the drum 400 is regulated using high-temperature steam supplied from the steam generating device 600, rather than wash water is heated using a heater (not shown). This is because heating wash water using a heater provided at the inner bottom surface of the tub 300 may damage the functional clothes due to direct contact between the high-temperature wash water and the functional clothes.

Accordingly, when the functional clothes course A is selected, the water supply step of the washing machine according to the present invention is performed such that cold water is supplied into the drum 400 and the interior temperature of the drum 400 is regulated only by high-temperature steam. The steam ejected into the drum 400 facilitates uniform permeation of water through the functional clothes without damage to the functional clothes.

As described above, since constituent materials of the functional clothes, such as for example Gore-tex® and Coolmax®, are susceptible to heat damage, in the washing machine according to the embodiment of the present invention, the interior temperature of the drum 400 is controlled by the controller (not shown) to keep a range of 25° C. to 30° C. during the water supply step, and preferably, is 27° C. or less. That is, the interior temperature of the drum 400 must be more than 25° C. in consideration of washing capability, but 30° C. or less to prevent damage to the functional clothes.

In conclusion, according to the present embodiment, damage to the functional clothes can be prevented because permeation of water through the functional clothes in the water supply step is performed via steam ejection and moreover, the functional cloths has no risk of high-temperature damage because the interior temperature of the drum 400 is controlled to a range of 25° C. to 30° C. and preferably, to 27° C. or less.

After completion of the water supply step, the drum 400 is intermittently rotated under the control of the controller (not shown) to perform the washing of the functional clothes (S430). In the present invention, the rotation of the drum 400 is controlled such that a total rotation time of the drum 400 is shorter than a total stoppage time of the drum 400.

As the rotation time of the drum 400 increases in the washing step, the washing capability increases, but damage to the functional clothes also increases. Therefore, the present embodiment proposes to prevent damage to the functional clothes by increasing a stoppage time of the drum 400.

More specifically, in the present embodiment, a stoppage time of the drum 400 is controlled to be more than double a rotation time of the drum 400. For example, if the drum 400 is rotated for about 5 seconds, the drum 400 is subsequently stopped for 10 seconds or more and again, is rotated for about 5 seconds. The longer stoppage time of the drum 400 enables more efficient prevention of damage to the functional clothes. Preferably, if the drum 400 is rotated for about 5 seconds, the drum 400 is subsequently stopped for about 19 seconds.

When the functional clothes are washed by the above-described washing step, it is possible to prevent damage to the functional clothes due to fiction between the functional clothes and the drum 400.

Subsequent to the washing step, a rinsing step to rinse the functional clothes is performed (S450). In the rinsing step, cold water is supplied to rinse the functional clothes via rotation of the drum 400. Generally, rotation rpm of the drum 400 is not high during the rinsing step and therefore, does not damage the functional clothes.

Subsequent to the rinsing step, a dehydrating step to dehydrate the functional clothes is performed (S470). Generally, the drum 400 has the highest rotation rpm in the dehydrating step. Accordingly, if the drum 400 is rotated at high rpm, for example, 800 rpm or more to dehydrate the functional clothes in the same manner as a conventional washing machine, it may cause damage to the functional clothes due to friction between the functional clothes and the drum 400. For this reason, in the present embodiment, the dehydrating step is performed at reduced rpm and preferably, at half conventional rpm, i.e. 400 rpm or less, thereby preventing damage to the functional clothes.

Although the rinsing step and dehydrating step may be performed only once, it is preferable to repeatedly perform the rinsing step and dehydrating step two or three times in order to entire remove detergent, and the like contained in clothes. The functional clothes course A is ended as the dehydrating step is completed.

It will be apparent to those skilled in the art that various modifications and variations can be made in the present invention without departing from the spirit or scope of the inventions. Thus, it is intended that the present invention covers the modifications and variations of this invention provided they come within the scope of the appended Claims and their equivalents.

As apparent from the above description, the washing machine and control method thereof according to the present invention enable washing of functional clothes including sportswear without damage.

Further, according to the present invention, the interior temperature of a drum can be regulated using steam during a washing operation. This has the effect of reducing the supply amount of wash water as compared to a general washing course.

Furthermore, according to the present invention, temperature regulation using steam ejected into the drum enables uniform permeation of water through clothes.

What is claimed is:

1. A method for controlling a washing machine comprising:

supplying water into a tub;

washing an object to be washed while rotating a drum;

rinsing the washed object; and dehydrating the washed object to remove moisture from the object, wherein steam is supplied into the drum simultaneously with the supply of cold water in the water supply step, to regulate the interior temperature of the drum, the drum is intermittently rotated in the washing step and the rotation of the drum is controlled such that drum rotating periods are always shorter than drum stoppage periods in the washing step and thereby a total stoppage time of the drum during the washing step is longer than a total rotation time of the drum during the washing step, a rotation rpm of the drum is regulated to 400 rpm or less in the dehydrating step, and the method further comprises sensing the interior temperature of the drum.

2. The method according to claim 1, wherein the interior temperature of the drum is regulated to a range of 25° C. to 30° C.

3. The method according to claim 1, wherein the interior temperature of the drum is regulated to 27° C. or less.

4. The method according to claim 1, wherein the total stoppage time of the drum is more than double the total rotation time of the drum.

* * * * *